US010898410B2

(12) United States Patent
Chung et al.

(10) Patent No.: US 10,898,410 B2
(45) Date of Patent: Jan. 26, 2021

(54) OSCILLATING HEALTH DEVICE

(71) Applicants: Ching-Chi Chung, Jiuru Township, Pingtung County (TW); Chi-Hsin Chung, Jiuru Township, Pingtung County (TW); Yi-Ping Chung, Jiuru Township, Pingtung County (TW); Chi-Hung Chung, Jiuru Township, Pingtung County (TW)

(72) Inventors: Ching-Chi Chung, Jiuru Township, Pingtung County (TW); Chi-Hsin Chung, Jiuru Township, Pingtung County (TW); Yi-Ping Chung, Jiuru Township, Pingtung County (TW); Chi-Hung Chung, Jiuru Township, Pingtung County (TW)

( * ) Notice: Subject to any disclaimer, the term of this patent is extended or adjusted under 35 U.S.C. 154(b) by 493 days.

(21) Appl. No.: 15/942,601

(22) Filed: Apr. 2, 2018

(65) Prior Publication Data

US 2019/0298604 A1 Oct. 3, 2019

(51) Int. Cl.
*A61H 23/02* (2006.01)
*A61H 23/00* (2006.01)

(52) U.S. Cl.
CPC ..... *A61H 23/0218* (2013.01); *A61H 23/004* (2013.01); *A61H 2023/0227* (2013.01)

(58) Field of Classification Search
CPC ..... A61H 23/00; A61H 23/004; A61H 23/02; A61H 23/0218; A61H 2201/0153; A61H 2023/0227
See application file for complete search history.

(56) References Cited

U.S. PATENT DOCUMENTS 3,467,080 A * 9/1969 McNair ..... A61H 23/0218 601/18
4,441,487 A * 4/1984 Daugherty ..... A61H 23/0218 132/73
4,710,655 A * 12/1987 Masaki ..... B06B 1/045 310/30
2005/0187071 A1* 8/2005 Yamashita ..... D04B 1/102 482/1
2011/0166486 A1* 7/2011 Kumanomido .... A61H 23/0236 601/15
2014/0361642 A1* 12/2014 Seo ..... A43B 3/0015 310/36

FOREIGN PATENT DOCUMENTS

KR 2128378 * 6/2020 ..... A61H 23/0218

* cited by examiner

*Primary Examiner* — Michael J Tsai
(74) *Attorney, Agent, or Firm* — Alan D. Kamrath; Mayer & Williams PC

(57) ABSTRACT

An oscillating health device includes a top cover and a bottom cover. The top cover and the bottom cover, each of which is made of a titanium sheet and molded in a metal stamping process, are welded together for development of a box body. The box body is provided with a drive element unit inside, and both the top cover and the bottom cover accommodate an oscillating hoop in between. The drive element unit enables a lamina lever of the oscillating hoop to induce vibrations which are transferred to the box body for generation of regular low-frequency oscillation, so that a health effect can be produced when the box body is in contact with a user's human body.

3 Claims, 3 Drawing Sheets

OSCILLATING HEALTH DEVICE

BACKGROUND OF THE INVENTION

1. Field of the Invention

The present invention relates to an oscillating health device and, more particularly, to a health device with a titanium box body from which low-frequency oscillations for good human health protection are produced.

2. Description of the Related Art

The modern people who sustain high life stresses and keep the fast work pace are suffering from fatigue and aches at shoulders, necks, waists or legs frequently. Particularly, the elders whose physical functions are aging and joints are degenerating need correct methods or equipment to relieve or moderate stresses, fatigues or pains. In this regard, massage as a method to relieve stresses and pains is effective in stretching muscles, dredging vessels, relaxing minds and even moderating disease-induced pains by hands rubbing sites of fatigues or pains directly. However, the force applied on a site of fatigues by fingers may be too strong or modest. Accordingly, a massager for massages should be a preferred option.

Titanium (Ti) existing in the form of titanium dioxide is characteristic of some good properties including light weight, corrosion resistance and high strength. In general, titanium is combined with oxygen easily for generation of a layer of oxide film on the surface at room temperature. On the other hand, titanium dioxide ($TiO_2$) which has been widely applied for years features three polymorphs, that is, the anatase structure with the best photocatalysis activity, the rutile structure and the brookite structure. As a semiconductor, titanium dioxide predominantly in the anatase phase with the best photocatalysis activity has the electrical conductivity between metals and insulators and degrades organic compounds under ultraviolet irradiations. Accordingly, anatase with the capacity of promoting chemical transformation due to photocatalysis draws more attentions. The photocatalyst is a catalyst relying on light energy to enable the catalytic reaction which oxidizes or reduces foreign substances on an object for decontamination, sterilization, bacteriostasis, and surface cleaning.

Currently, the products for massage health and medical treatment based on properties of titanium are still unavailable.

A high-quality titanium-based health product should be researched and designed by advanced techniques because of physical properties, good mechanical performance and biocompatibility, and photocatalysis of titanium.

BRIEF SUMMARY OF THE INVENTION

Thus, an objective of the present invention is to provide an oscillating health device which includes a hollow box body which is made of titanium and produces low-frequency oscillations constantly for health care and medical treatment effects.

To achieve this and other objectives, an oscillating health device of the present invention includes a top cover, a bottom cover, and an oscillating hoop. Each of the top cover and the bottom cover is made of a titanium sheet, and each of the top cover and the bottom cover is a shell body with a recess space and an open end surface. The open end surface of the bottom cover is combined with the open end surface of the top cover for development of a box body. The oscillating hoop is a laminar annulus fixed between the open end surface of the top cover and the open end surface of the bottom cover. The oscillating hoop includes a lamina lever integrally extending toward a center of the oscillating hoop from an inner edge of the oscillating hoop and including a hammer portion at a tail end thereof. A drive element unit is provided at an inner side of either the top cover or the bottom cover and enables the hammer portion as well as the lamina lever to produce periodic vibrations which are transferred to the box body for generation of regular low-frequency oscillations.

The oscillating health device of the present invention is effective in producing regular oscillations at a titanium box body that contacts with a user for a health care effect.

In an embodiment, the drive element unit is installed at the inner side of the top cover and includes a solenoid valve with an IC chip which provides a cycle timer function to activate the solenoid valve. A battery cell is electrically connected to the solenoid valve for supply of electric power to the solenoid valve that is enabled to hit the hammer portion of the lamina lever periodically for production of regular vibrations at both the lamina lever and the hammer portion.

In an embodiment, the top cover is provided with a through-hole which is sealed with a plug lid, and the drive element unit is installed at a bottom of the plug lid and can be checked and replaced with the plug lid removed.

The present invention will become clearer in light of the following detailed description of an illustrative embodiment of this invention described in connection with the drawings.

DESCRIPTION OF THE DRAWINGS

The illustrative embodiment may best be described by reference to the accompanying drawings where.

DETAILED DESCRIPTION OF THE INVENTION

Figure 1:
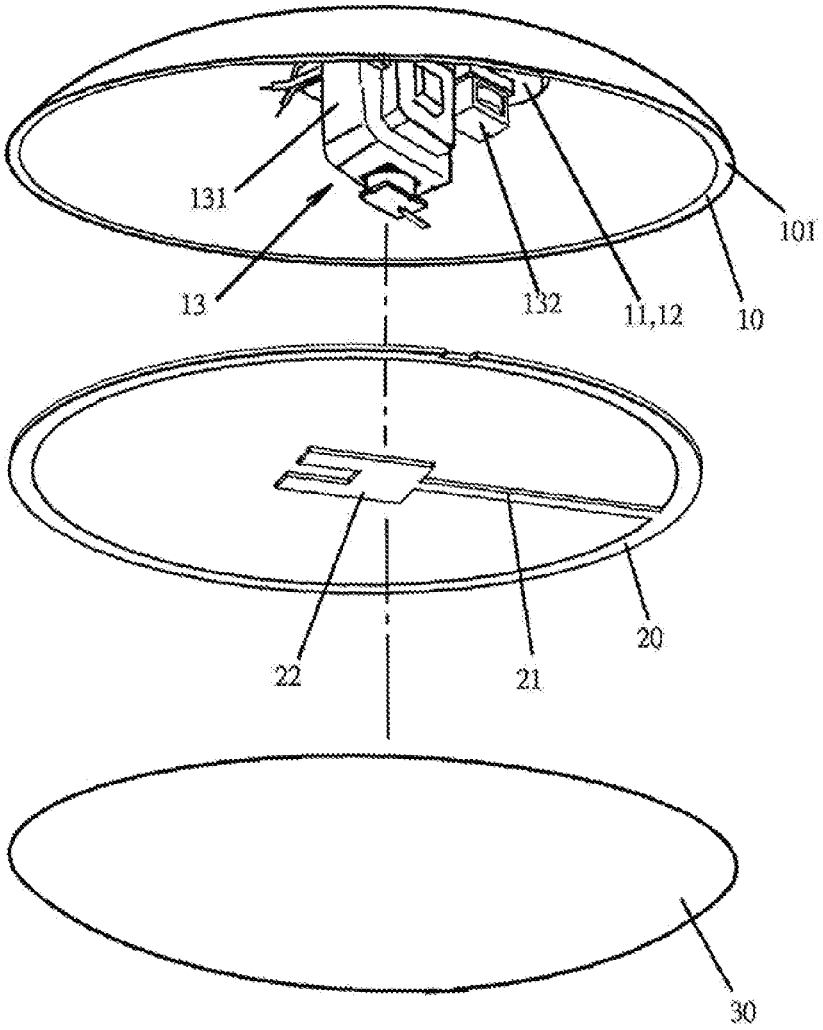
FIG. 1 is an exploded, schematic view illustrating an oscillating health device according to an embodiment of the present invention.
Figure 2:
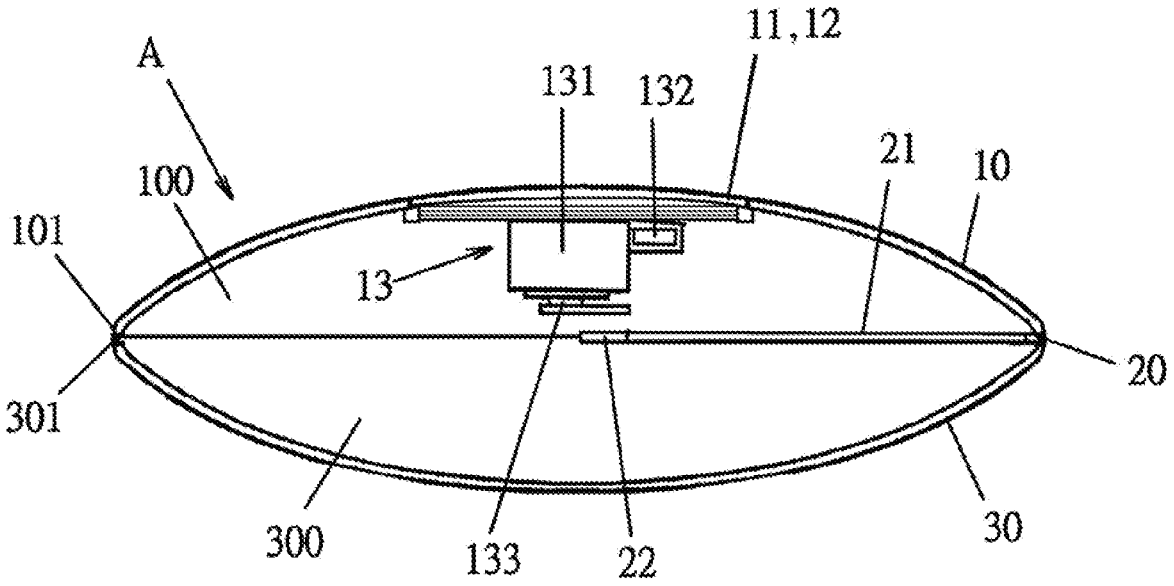
FIG. 2 is a sectional, schematic view of the oscillating health device of FIG. 1.

An oscillating health device according to the present invention is shown in FIGS. 1 and 2 of the drawings and generally includes a top cover 10, an oscillating hoop 20, and a bottom cover 30. The top cover 10 is a shell body having a recess space 100 and an open end surface 101. The top cover 10 is made of a titanium sheet and molded in a metal stamping process and has a through-hole 11 which is sealed with a plug lid 12. In this embodiment, the plug lid 12 is screwed into the through-hole 11 for an airtight condition, but this invention is not limited thereto. A drive element unit 13 is provided at an inner side of the top cover 10 and includes a solenoid valve 131 with an integrated circuit (IC) chip through which a cycle timer function is available. A driven element 133 is enabled by the solenoid valve 131 for an intermittent stretch or retraction motion. The drive element unit 13 further includes a battery cell 132 which supplies electric power to the solenoid valve 131 to be activated. Preferably, the drive element unit 13 is installed at the bottom of the plug lid 12 such that the drive element unit 13 can be checked and repaired with the plug lid 12 removed.

The oscillating hoop 20 is a laminar annulus with a shape matching that of the open end surface 101 of the top cover 10. A lamina lever 21 is integrally molded with the oscillating hoop 20 and extends toward a center of the oscillating hoop 20 from an inner edge of the oscillating hoop 20. The lamina lever 21 includes a hammer portion 22 at a tail end thereof.

The bottom cover 30, which is a shell body with a recess space 300 and an open end surface 301, is molded with a titanium sheet in an impact molding process. The bottom cover 30 and the top cover 10 are mutually symmetric in shape. The open end surface 301 of the bottom cover 30 is combined with the open end surface 101 of the top cover 10 correspondingly for development of an intact box body (A) with a smooth surface.

For assembly of the oscillating health device, the top cover 10, the oscillating hoop 20 and the bottom cover 30 is piled up sequentially and welded together, wherein the oscillating hoop 20 is fixed between the open end surface 101 of the top cover 10 and the open end surface 301 of the bottom cover 30 with the lamina lever 21 located inside the box body (A). When the solenoid valve 131 of the drive element unit 13 is enabled, the hammer portion 22 of the lamina lever 21 of the oscillating hoop 20 is hit by the driven element 133 for generation of periodic flapping vibrations at both the lamina lever 21 and the hammer portion 22.

Figure 3:
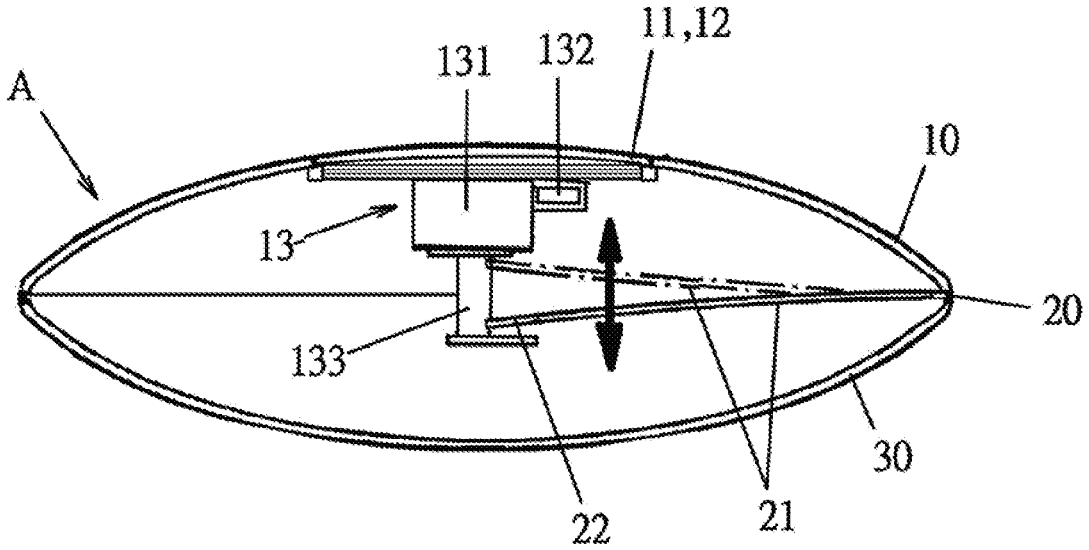
FIG. 3 is a schematic view which illustrates oscillations in the oscillating health device of FIG. 2.

As shown in FIG. 3, the flapping vibrations of the lamina lever 21 and the hammer portion 22 of the oscillating hoop 20 induced by the enabled solenoid valve 131 are transferred to the top cover 10 and the bottom cover 30 for development of regular low-frequency oscillations at the box body (A). In practice, the oscillatory box body (A) contacting with a user properly will massage the user's human body, stimulating acupoints and relieving muscle fatigues for a health effect.

The oscillating health device of the present invention is characteristic of advantages and effects as follows 1. Regular and constant oscillations can be induced on the box body (A), which consists of the top cover 10, the oscillating hoop 20 and the bottom cover 30, by the oscillatory hammer portion 22 on the lamina lever 21 of the oscillating hoop 20 for the health effect.

2. Regular oscillations at the box body (A) are transformed from periodic vibrations of the lamina lever 21 of the oscillating hoop 20. The lamina lever 21 and the oscillating hoop 20 are molded integrally for good product durability and oscillation quality without the problem of embrittlement at a welding bead at which stresses are applied.

3. Each of the top cover 10 and the bottom cover 30 is made of a light, robust and corrosion-resistant titanium sheet with the anatase structure for photocatalysis which contributes to decontamination, sterilization and bacteriostasis effects.

4. The drive element unit 13 installed at the bottom of the plug lid 12 can be checked or replaced via the through-hole 11 and the plug lid 12 easily.

The drive element unit 13 arranged at the inside of the top cover 10 in this embodiment can be installed at the inside or the bottom of the bottom cover 30 optionally. Moreover, the box body (A) which is elliptic in shape in this embodiment can be designed as an object with another shape.

The oscillating health device of the present invention effectuates advantages of titanium and the health effect based on oscillations for synergistic actions and good practicability and availability of the industry.

The scope of the invention is to be indicated by the appended claims, rather than by the foregoing description, and all changes which come within the meaning and range of equivalency of the claims are intended to be embraced therein.

The invention claimed is:

1. An oscillating health device comprising a top cover, a bottom cover and an oscillating hoop, with each of the top cover and the bottom cover made of a titanium sheet, with each of the top cover and the bottom cover being a shell body having a recess space and an open end surface, with the open end surface of the bottom cover combined with the open end surface of the top cover for development of a box body, with the oscillating hoop being a laminar annulus fixed between the open end surface of the top cover and the open end surface of the bottom cover, with the oscillating hoop including a lamina lever which is integrally extends toward a center of the oscillating hoop from an inner edge of the oscillating hoop, with the lamina lever including a hammer portion at a tail end thereof, with a drive element unit provided at an inner side of either the top cover or the bottom cover and enabling the hammer portion as well as the lamina lever to produce periodic vibrations which are transferred to the box body for generation of regular low-frequency oscillations.

2. The oscillating health device according to claim 1, wherein the drive element unit is installed at the inner side of the top cover and includes a solenoid valve with an integrated circuit (IC) chip through which a cycle timer function is available to activate the solenoid valve, wherein a battery cell is electrically connected to the solenoid valve for supply of electric power to the solenoid valve that is enabled to hit the hammer portion of the lamina lever periodically for production of regular vibrations at both the lamina lever and the hammer portion.

3. The oscillating health device according to claim 1, wherein the top cover is provided with a through-hole which is sealed with a plug lid, wherein the drive element unit is installed at a bottom of the plug lid and can be checked and replaced with the plug lid removed.

* * * * *